US012075907B2

(12) United States Patent
Kimoto

(10) Patent No.: US 12,075,907 B2
(45) Date of Patent: Sep. 3, 2024

(54) TOOTHBRUSH

(71) Applicant: Lion Corporation, Tokyo (JP)

(72) Inventor: Yuya Kimoto, Tokyo (JP)

(73) Assignee: Lion Corporation, Tokyo (JP)

( * ) Notice: Subject to any disclaimer, the term of this patent is extended or adjusted under 35 U.S.C. 154(b) by 460 days.

(21) Appl. No.: 17/417,088

(22) PCT Filed: Dec. 26, 2019

(86) PCT No.: PCT/JP2019/051094
§ 371 (c)(1),
(2) Date: Jun. 21, 2021

(87) PCT Pub. No.: WO2020/138275
PCT Pub. Date: Jul. 2, 2020

(65) Prior Publication Data

US 2022/0071382 A1 Mar. 10, 2022

(30) Foreign Application Priority Data

Dec. 27, 2018 (JP) ..... 2018-246151

(51) Int. Cl.
*A46B 15/00* (2006.01)
*A46B 5/02* (2006.01)

(52) U.S. Cl.
CPC ..... *A46B 15/004* (2013.01); *A46B 5/02* (2013.01); *A46B 2200/1066* (2013.01)

(58) Field of Classification Search
CPC ..... A46B 15/0012; A46B 15/0038; A46B 15/0002; A46B 5/0066; A46B 5/02; A46B 9/04
See application file for complete search history.

(56) References Cited

U.S. PATENT DOCUMENTS 4,520,526 A 6/1985 Peters
5,146,645 A 9/1992 Dirksing
(Continued)

FOREIGN PATENT DOCUMENTS

CN 102949001 A 3/2013
CN 103442614 A 12/2013
(Continued)

OTHER PUBLICATIONS

European Patent Office, "Extended European Search Report" in connection with related European Patent Application No. 19905626.8, dated Oct. 14, 2022, 9 pgs.
(Continued)

*Primary Examiner* — Shay Karls
(74) *Attorney, Agent, or Firm* — Kolisch Hartwell, P.C.

(57) ABSTRACT

An object of the present invention is to provide a toothbrush that enables an appropriate brushing pressure to be more reliably recognized. A head portion (10) provided on a tip end side in a long axis direction and having a bristle tufting surface (11), a grip portion (30) disposed on a rear end side from the head portion, and a neck portion (20) disposed between the bristle tufting surface and the grip portion are provided. A sound generation portion (70) that generates a click sound due to deformation when an external force in a first direction orthogonal to the bristle tufting surface exceeds a threshold value is provided on a rear end side from the bristle tufting surface.

8 Claims, 5 Drawing Sheets

(56) References Cited

U.S. PATENT DOCUMENTS

| | | | | |
|---|---|---|---|---|
| 8,973,202 | B2 | 3/2015 | Fischer et al. | |
| 2014/0020198 | A1* | 1/2014 | Slocum ..... | A46B 15/004<br>15/167.1 |

FOREIGN PATENT DOCUMENTS

| | | | | | |
|---|---|---|---|---|---|
| DE | 9310112 | U1 | 6/1994 | | |
| JP | 51085871 | U | 7/1976 | | |
| JP | 60010529 | U | 1/1985 | | |
| JP | 02501446 | A | 5/1990 | | |
| JP | 06504937 | A | 6/1994 | | |
| JP | 4118067 | B | 7/2008 | | |
| JP | 2013043039 | A | 3/2013 | | |
| TW | 201611753 | A | 4/2016 | | |
| WO | 2001021035 | A1 | 3/2001 | | |
| WO | WO-0121035 | A1 * | 3/2001 | ..... | A46B 15/0002 |
| WO | WO-2007110208 | A1 * | 10/2007 | ..... | A46B 15/0055 |

OTHER PUBLICATIONS

Japan Patent Office, "Notice of Reasons for Rejection" in connection with related Japanese Patent Application No. 2020-562398, dated Oct. 17, 2023, 5 pages.

Japanese Patent Office, "International Search Report" in connection with related International Application No. PCT/JP2019/051094, dated Mar. 10, 2020, 5 pgs.

China National Intellectual Property Administration, "First Office Action" in connection with related Chinese Patent Application Serial No. 201980085529.9, dated Mar. 25, 2022, 16 pgs.

Taiwan Intellectual Property Office, "Office Action" in connection with related Taiwanese Patent App. No. 108147749, translated Search Report, dated Dec. 21, 2022, 9 pgs.

Intellectual Property India, "Examination Report" in connection with related Indian Patent App. No. 202117027248, dated Nov. 11, 2022, 7 pgs.

Miyabe, Aiko, Examiner, Japanese Patent Office, "Notice of Allowance" in connection with related Japanese Patent Application No. 2020-562398, dated Jul. 2, 2024, 6 pgs.

* cited by examiner

TOOTHBRUSH

TECHNICAL FIELD

The present invention relates to a toothbrush.

Priority is claimed on Japanese Patent Application No. 2018-246151 filed on Dec. 27, 2018, the content of which is incorporated herein by reference.

BACKGROUND ART

While the proportion of people at the age of 80 who have 20 teeth is approximately 50%, the proportion of elderly caries (root surface caries) has increased. Root caries is caries of dentin exposed due to gingival recession, and since dentin has a higher composition ratio of organic components than enamel, caries progresses faster. One example of a cause of gingival recession is over-brushing, in which brushing is performed at a brushing pressure larger than that of an appropriate value.

Since the brushing pressure is defined by a load/bristle tufting area, reducing the brushing pressure can be achieved by at least one of reducing the load and increasing the bristle tufting area. To reduce the load, a toothbrush having a specification designed to incline a neck portion above a bristle tufting surface in advance, to bend the neck portion when brushing, and to be brushed with a force straightening the neck portion when brushing, a soft toothbrush having a specification that uses bristles with a small diameter, a toothbrush having a specification in which the center of gravity of a grip portion is disposed closer to a rear end portion of a handle so that force is not easily applied to a bristle tufting portion, or the like is commercially available. In addition, for increasing the bristle tufting area, a toothbrush having a wide head width and the like are commercially available. Incidentally, in these specifications, although it is possible to reduce the brushing pressure, it is difficult to make all users recognize the appropriate brushing pressure at the same level and control the brushing pressure.

In addition, although users are taught appropriate brushing methods at dentists offices, since it is difficult to deal with the brushing method by oneself because it is not clear how much force is applied, it is found that there are many users who are aware of over-brushing yet continue to over-brush.

Therefore, examples of means for causing a user to recognize an appropriate brushing pressure include a toothbrush disclosed in Patent Document 1. In Patent Document 1, a toothbrush made of an elastic material such as a stainless steel sheet that can be reversed so that the head portion warps when a head support portion between a head portion and a grip portion is brushed at a predetermined pressure or higher is disclosed.

The toothbrush disclosed in Patent Document 1 can cause a user to recognize that an appropriate brushing pressure is exceeded by warping the head portion.

CITATION LIST

Patent Document

Patent Document 1

Japanese Patent No. 4118067

SUMMARY OF INVENTION

Technical Problem

However, in the toothbrush disclosed in Patent Document 1 described above, it can only be recognized with the fingers that the appropriate brushing pressure has been exceeded, and it cannot be said that it is sufficient to more reliably recognize that the appropriate brushing pressure is exceeded.

The present invention has been made in consideration of the above points, and an object thereof is to provide a toothbrush that enables an appropriate brushing pressure to be more reliably recognized.

Solution to Problem

According to a first aspect of the present invention, there is provided a toothbrush including a head portion provided on a tip end side in a long axis direction and having a bristle tufting surface: a grip portion disposed on a rear end side from the head portion; a neck portion disposed between the bristle tufting surface and the grip portion; and a sound generation portion that generates a click sound due to deformation when an external force in a first direction orthogonal to the bristle tufting surface exceeds a threshold value, the sound generation portion being provided on a rear end side from the bristle tufting surface.

In addition, in the toothbrush according to one aspect of the present invention, a sound generated from the sound generation portion has a characteristic sound pressure level of 30 dB or more, and a frequency of 100 Hz or more and 10000 Hz or less.

In addition, in the toothbrush according to one aspect of the present invention, the sound generation portion includes a reversal portion that generates the click sound by being snapped, buckled, and reversed as the head portion is displaced on a back surface side opposite to the bristle tufting surface in the first direction due to the external force exceeding the threshold value.

In addition, in the toothbrush according to one aspect of the present invention, the sound generation portion includes an elastic deformation portion that connects a first region on the tip end side from the sound generation portion and a second region on the rear end side from the sound generation portion, and elastically deforms at least up to the external force at which the sound generation portion generates the click sound.

In addition, in the toothbrush according to one aspect of the present invention, the elastic deformation portion and the reversal portion are disposed with a gap in a second direction orthogonal to the first direction and the long axis direction.

In addition, in the toothbrush according to one aspect of the present invention, the elastic deformation portion includes a hard portion made of a hard resin and a soft portion made of a soft resin and covering the hard portion, and the reversal portion is made of a hard resin having a flexural modulus of 1500 MPa or more.

In addition, in the toothbrush according to one aspect of the present invention, a thickness of the elastic deformation portion in the first direction is 6 mm or more and 12 mm or less, the sound generation portion includes support portions made of the hard resin on both end sides in the long axis direction, and supporting both ends of the elastic deformation portion and the reversal portion in the long axis direction, and the reversal portion is reversed in a range of 1% or more and 30% or less of the thickness of the elastic deformation portion in the first direction, centering on a line segment connecting center points of thicknesses of the support portions in the first direction.

In addition, in the toothbrush according to one aspect of the present invention, the reversal portion has a protrusion shape toward the back surface side when an external force in the first direction is equal to or less than a threshold value, and a distance between an intersection portion on the back surface side with the support portion and an apex of the protrusion shape in the first direction is 0.5 mm or more and 4.2 mm or less.

In addition, in the toothbrush according to one aspect of the present invention, the reversal portion includes a groove portion extending in the second direction on at least one of the bristle tufting surface side and the back surface side in a region including an apex of the protrusion shape.

In addition, in the toothbrush according to one aspect of the present invention, a minimum thickness of the reversal portion in a region provided with the groove portion in the first direction is 0.1 mm or more and 1.0 mm or less.

In addition, in the toothbrush according to one aspect of the present invention, a thickness of the hard portion in the first direction is 1.0 mm or more and 2.0 mm or less.

Advantageous Effects of Invention

The present invention can provide a toothbrush that enables an appropriate brushing pressure to be more reliably recognized.

DESCRIPTION OF EMBODIMENTS

Hereinafter, embodiments of a toothbrush of the present invention will be described with reference to FIGS. 1 to 7.

The following embodiments illustrate one aspect of the present invention, do not limit the present invention, and can be randomly changed within the scope of the technical idea of the present invention. In addition, in the following drawings, in order to make each configuration easy to understand, the scale and number of each structure are different from those of the actual structure. In addition, in the following description, a direction orthogonal to a bristle tufting surface in a side view will be described as a vertical direction, a bristle tufting surface side will be described as an upper side, and a back surface side opposite to the bristle tufting surface will be described as a lower side as appropriate. The vertical direction, the upper side, and the lower side are names used only for description, and do not limit the actual positional relationships and directions in the present invention.

Figure 1:
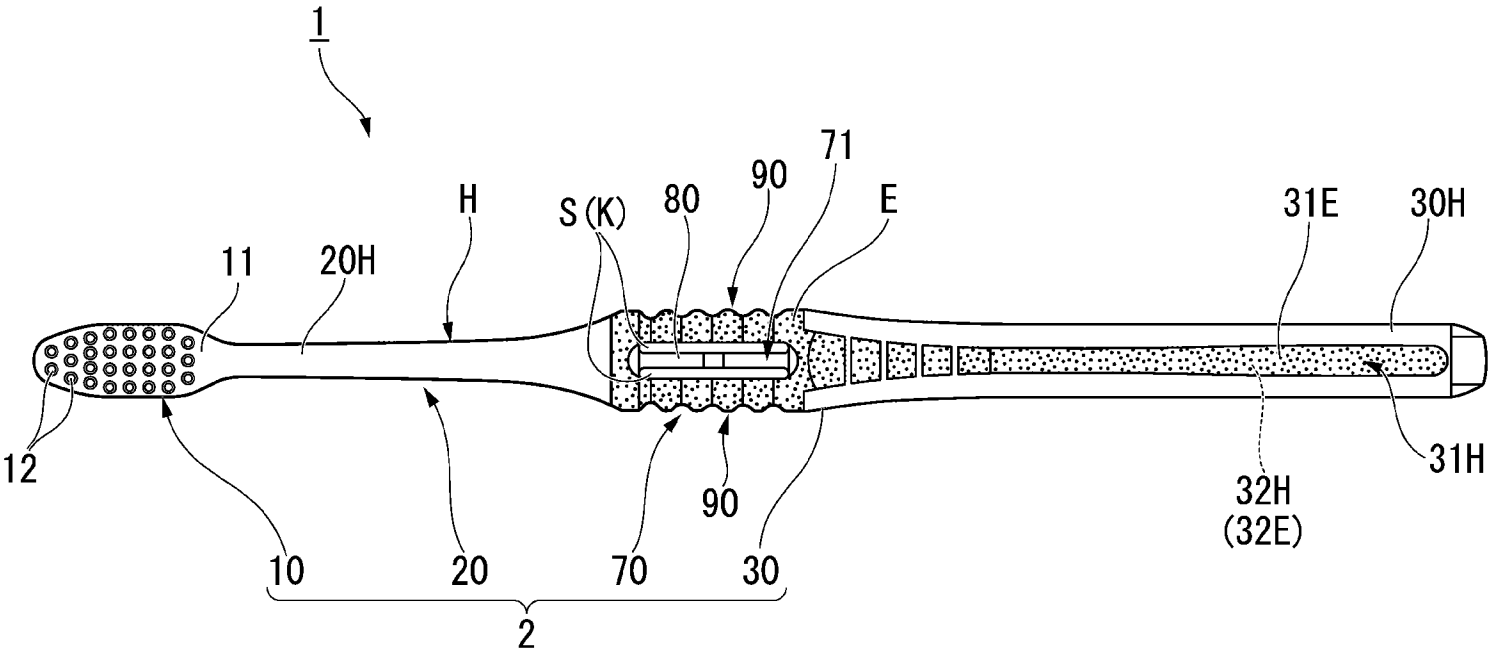
FIG. 1 is a view illustrating an embodiment of the present invention and is a front view of a toothbrush 1.
Figure 2:
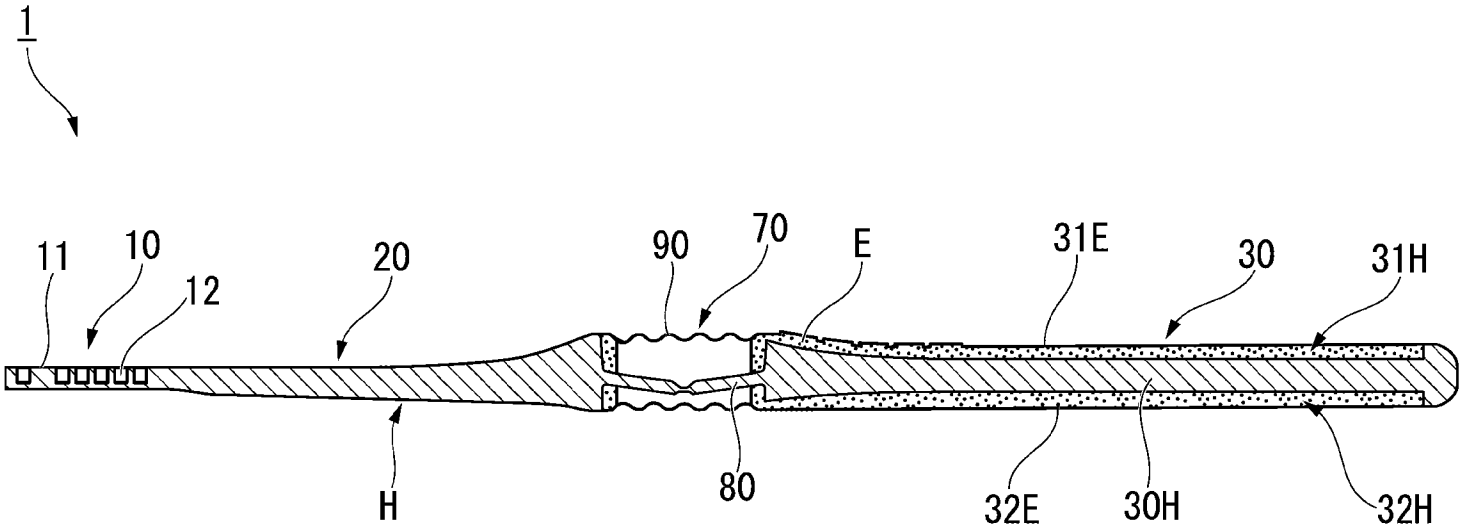
FIG. 2 is a cross-sectional view of the toothbrush 1 along a plane including a center in a width direction.

FIG. 1 is a front view of a toothbrush 1. FIG. 2 is a cross-sectional view of the toothbrush 1 along a plane including a center in a width direction (vertical direction in FIG. 1).

The toothbrush 1 of the present embodiment is provided with a head portion 10 disposed on a tip end side in the long axis direction (hereinafter, simply referred to as a tip end side) and on which a bristle bundle (not illustrated) of bristles is tufted, a neck portion 20 extending on a rear end side of the head portion 10 in the long axis direction (hereinafter, simply referred to as a rear end side), a sound generation portion 70 extending to a rear end side of the neck portion 20, and a grip portion 30 extending to a rear end side of the sound generation portion 70 (hereinafter, the head portion 10, the neck portion 20, the grip portion 30, and the sound generation portion 70 are collectively referred to as a handle body 2).

The toothbrush 1 of the present embodiment is a molded body in which a hard portion H made of a hard resin and a soft portion E made of a soft resin are integrally molded. The hard portion H constitutes at least a portion of each of the head portion 10, the neck portion 20, the grip portion 30, and the sound generation portion 70. The soft portion E constitutes a portion of each of the grip portion 30 and the sound generation portion 70 (details will be described later).

Head Portion 10

The head portion 10 includes a bristle tufting surface 11 on one side in the thickness direction (direction orthogonal to a paper surface in FIG. 1). Hereinafter, the bristle tufting surface 11 side in the thickness direction is defined as a front surface side in a front surface direction, the side opposite to the bristle tufting surface is defined as a back surface side, and a direction orthogonal to the thickness direction and the long axis direction is defined as a width direction (or as appropriate, a side surface direction). A plurality of bristle tufting holes 12 are formed on the bristle tufting surface 11. A bristle bundle of bristles (not illustrated) is tufted in the bristle tufting hole 12.

A width of the head portion 10, that is, a length in the width direction parallel to the bristle tufting surface 11 on the front surface side and orthogonal to the long axis direction (hereinafter, simply referred to as a width), is not particularly limited, and is preferably 7 mm or more and 13 mm or less, for example. When the width is the above lower limit value or more, a sufficient area for tufting the bristle bundle can be secured, and when the width is the above upper limit value or less, the operability in the oral cavity is further enhanced.

The length of the head portion 10 in the long axis direction (hereinafter, simply referred to as a length) is not particularly limited, and is preferably 10 mm or more and 33 mm or less, for example. When the length of the head portion 10 is the above lower limit value or more, a sufficient area for tufting the bristle bundle can be secured, and when the length is the above upper limit value or less, the operability in the oral cavity is further enhanced. A boundary between the neck portion 20 and the head portion 10 in the long axis direction in the present embodiment is a position where the width of the neck portion 20 is a minimum value from the neck portion 20 toward the head portion 10.

The length of the head portion 10 in the thickness direction (hereinafter, simply referred to as a thickness) can be determined in consideration of the material and the like, and is preferably 2.0 mm or more and 4.0 mm or less. When the thickness of the head portion 10 is the above lower limit value or more, the strength of the head portion 10 is further enhanced. When the thickness of the head portion 10 is the above upper limit value or less, the reachability to the rear of the molars can be enhanced and the operability in the oral cavity is further enhanced.

The bristle bundle is a bundle of a plurality of bristles. The length (bristle length) from the bristle tufting surface 11 to the tip end of the bristle bundle can be determined in consideration of a bristle waist and the like required for the bristle bundle, and is, for example, 6 to 13 mm. All the bristle bundles may have the same bristle length or may be different from each other.

A thickness of the bristle bundle (bristle bundle diameter) can be determined in consideration of the bristle waist and the like required for the bristle bundle, and is set to, for example, 1 to 3 mm. All the bristle bundles may have the same bristle bundle diameter or may be different from each other.

Examples of the bristles constituting the bristle bundle include bristles in which diameters gradually decrease toward a tip of the bristle and have sharpened tips of the bristles (tapered bristles), and bristles in which diameters from the bristle tufting surface 11 toward a tip of the bristle are substantially the same as each other (straight bristles). Examples of a straight bristle include a bristle in which a tip of the bristle is a plane substantially parallel to the bristle tufting surface 11, and a bristle in which a tip of the bristle is hemispherically rounded.

Examples of the material of the bristle include polyamides such as 6-12 nylon (6-12NY), 6-10 nylon (6-10NY), polyesters such as polyethylene terephthalate (PET), polybutylene terephthalate (PBT), polytrimethylene terephthalate (PTT), polyethylene naphthalate (PEN), polybutylene naphthalate (PBN), polyolefins such as polypropylene (PP), elastomer resins such as polyolefin-based elastomers and styrene-based elastomers, and the like. These resin materials can be used alone or in a combination of two or more. In addition, examples of the bristle include a polyester bristle with a multi-core structure having a core portion and at least one or more layers of sheath portions provided on the outside of the core portion.

The cross-sectional shape of the bristle is not particularly limited, and may be a circular shape such as a perfect circle or an ellipse, a polygonal shape, a star shape, a three-leaf clover shape, a four-leaf clover shape, or the like. The cross-sectional shapes of all the bristles may be the same as each other or different from each other.

The thickness of the bristle can be determined in consideration of the material and the like, and in a case where the cross section is circular, the thickness is, for example, 6 to 9 mil (1 mil=1/1000 inch=0.025 mm). In addition, a plurality of bristles having different thicknesses may be used in any combination in consideration of usability, brushing feeling, cleaning effect, durability, and the like.

Neck Portion 20

The length of the neck portion 20 is preferably 40 mm or more and 70 mm or less in terms of operability.

As an example, the width of the neck portion 20 is formed to gradually increase from a position where the minimum value is obtained toward the rear end side. The neck portion 20 in the present embodiment is formed to gradually increase from a position where the width has a minimum value toward the rear end side. In addition, the neck portion 20 is formed to gradually increase from a position where the thickness has a minimum value toward the rear end side.

The width and thickness of the neck portion 20 at the minimum position are preferably 3.0 mm or more and 4.5 mm or less. When the width and thickness of the neck portion 20 at the minimum position are the above lower limit value or more, the strength of the neck portion 20 is further enhanced. When the width and thickness are the above upper limit value or less, the lips are likely to be closed, the reachability to the molars is enhanced, and the operability in the oral cavity is further enhanced. The width and thickness of the neck portion 20 formed to gradually increase from the position where the minimum value is obtained toward the rear end side can be appropriately determined in consideration of the material and the like.

The front surface side of the neck portion 20 in the side view is inclined toward the front surface side and toward the rear end side. The back surface side of the neck portion 20 in the side view is inclined toward the back surface side and toward the rear end side. The neck portion 20 is inclined in a direction where a distance from the center in the width direction increases toward the rear end side in a front view.

The boundary between the neck portion 20 and the sound generation portion 70 in the present embodiment is the position of the tip end on the neck side 20 where an elastic deformation portion 90 that will be described later is provided. Here, the width is expanded from the neck portion 20 toward the grip portion 30 with an arcuate contour in both a front view and a side view, and a position of the center of curvature of the arc coincides with a changed position in the long axis direction. More specifically, the boundary between the neck portion 20 and the sound generation portion 70 coincides with a position in the long axis direction where the center of curvature changes from the outside of the arcuate contour to the center side in the width direction in the front view illustrated in FIG. 1. In addition, the boundary between the neck portion 20 and the sound generation portion 70 coincides with a position in the long axis direction where the center of curvature changes from the outside of the arcuate contour to the center side in the thickness direction in a side view illustrated in FIG. 2.

Grip Portion 30

The grip portion 30 is disposed in the long axis direction. As illustrated in FIG. 1, a length of the grip portion 30 in the width direction gradually narrows from the boundary with the sound generation portion 70 toward the rear end side, and then extends at a substantially constant length. As illustrated in FIG. 2, a length of the grip portion 30 in the thickness direction gradually narrows from the boundary with the sound generation portion 70 toward the rear end side, and then extends at a substantially constant length.

The boundary between the sound generation portion 70 and the grip portion 30 in the present embodiment is the position of the tip end on the grip portion side 30 where the elastic deformation portion 90 that will be described later is provided. Here, the width is reduced from the sound generation portion 70 toward the grip portion side 30 with an arcuate contour in both a front view and a side view, and a position of the center of curvature of the arc coincides with a changed position in the long axis direction. More specifically, the boundary between the sound generation portion 70 and the grip portion 30 coincides with a position in the long axis direction where the center of curvature changes from the center side in the width direction to the outside of the arcuate contour in the front view illustrated in FIG. 1. In addition, the boundary between the sound generation portion 70 and the grip portion 30 coincides with a position in the long axis direction where the center of curvature changes from the center side in the thickness direction to the outside of the arcuate contour in the side view illustrated in FIG. 2.

The position in the long axis direction where the length of the grip portion 30 in the width direction gradually narrows from the boundary with the sound generation portion 70 toward the rear end side and then is a substantially constant length, and the position in the long axis direction where the length of the grip portion 30 in the thickness direction gradually narrows from the boundary with the sound generation portion 70 toward the rear end side and then is a substantially constant length are the same as each other.

The grip portion 30 includes a soft portion 31E at the center in the width direction on the front surface side. The soft portion 31E constitutes a portion of the soft portion E. The soft portion 31E gradually narrows from the boundary with the sound generation portion 70 toward the rear end side in the front view, and then extends at a substantially constant length. A side edge of the soft portion 31E and a side edge of the grip portion 30 on the outside in the width direction are formed at a substantially constant distance in the front view.

The grip portion 30 includes a hard portion 30H. The hard portion 30H constitutes a portion of the hard portion H. The hard portion 30H includes a hollow 31H in which a portion of the soft portion 31E is embedded on the front surface side. The hollow 31H gradually narrows from the boundary with the sound generation portion 70 toward the rear end side in the front view, and then extends at a substantially constant length.

A portion of the soft portion 31E protrudes from the hard portion 30H exposed on the front surface side. The other soft portion 31E is substantially flush with the hard portion 30H exposed on the front surface side.

The grip portion 30 includes a soft portion 32E at the center in the width direction on the back surface side (refer to FIGS. 1 and 2). The soft portion 32E constitutes a portion of the soft portion E. The soft portion 32E has substantially the same outer contour as the outer contour of the soft portion 31E in the front view. That is, the soft portion 32E gradually narrows from the boundary with the sound generation portion 70 toward the rear end side, and then extends at a substantially constant length. In a rear view, a side edge of the soft portion 32E and a side edge of the grip portion 30 on the outside in the width direction are formed at a substantially constant distance.

The hard portion 30H includes a hollow 32H (refer to FIG. 2) in which a portion of the soft portion 32E is embedded on the back surface side. The hollow 32H gradually narrows from the boundary with the sound generation portion 70 toward the rear end side in the rear view, and then extends at a substantially constant length.

A portion of the soft portion 32E protrudes from the hard portion 30H exposed on the back surface side. The other soft portion 32E is substantially flush with the hard portion 30H exposed on the front surface side.

Since the soft portion 31E is provided on the front surface side of the grip portion 30 and the soft portion 32E is provided on the back surface side, the grip property when the grip portion 30 is gripped is improved.

Sound Generation Portion 70

The sound generation portion 70 deforms when the external force in the first direction orthogonal to the bristle tufting surface 11 exceeds the threshold value to generate a click sound. As illustrated in FIG. 1, the sound generation portion 70 includes a reversal portion 80 and an elastic deformation portion 90 which connect the neck portion 20 on the tip end side from the sound generation portion 70 and the grip portion 30 on the rear end side from the sound generation portion 70.

Figure 3:
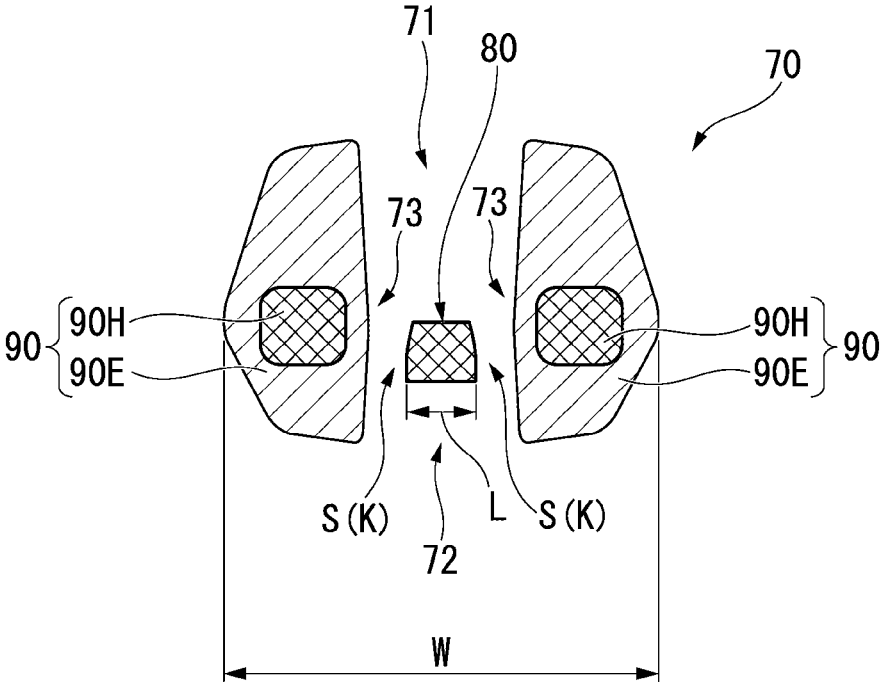
FIG. 3 is a cross-sectional view of a sound generation portion 70 along a plane parallel to a thickness direction and the width direction.
Figure 4:
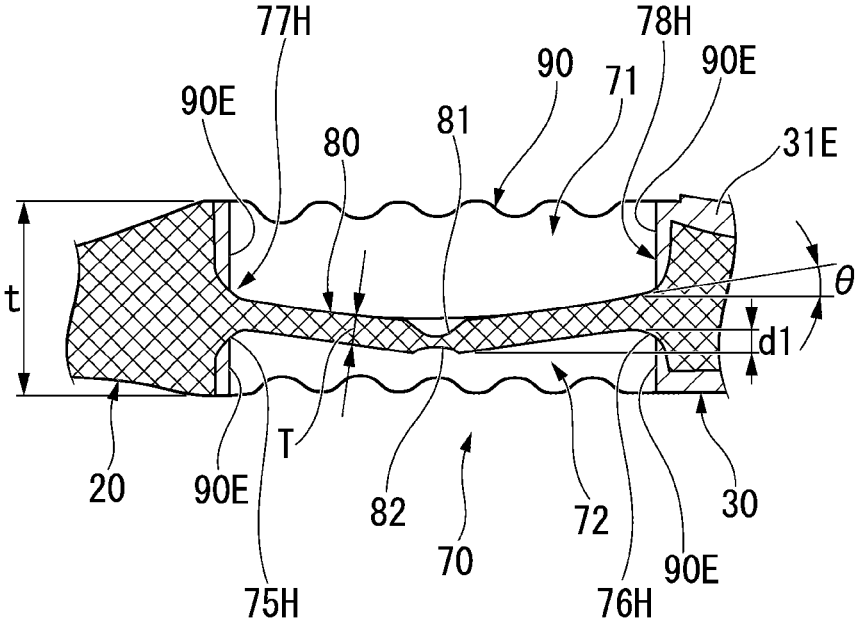
FIG. 4 is a cross-sectional view of the sound generation portion 70 along a plane parallel to the thickness direction and a long axis direction.

FIG. 3 is a cross-sectional view of the sound generation portion 70 along a plane parallel to a thickness direction and the width direction. FIG. 4 is a cross-sectional view of the sound generation portion 70 along a plane parallel to the thickness direction and a long axis direction.

As illustrated in FIG. 3, the elastic deformation portions 90 are each provided with gaps S on both sides of the reversal portion 80 in the width direction. The gaps S include a through-hole K penetrating in the thickness direction. As illustrated in FIG. 1, the through-hole K is formed in a rectangular shape in a plan view extending in the long axis direction.

By providing the gaps S, the reversal portion 80 can be reversed (easily reversed) without interfering with the periphery structure. In addition, since the deformation of the reversal portion 80 does not follow the deformation of the elastic deformation portion (because there is no interference), the functional roles (to be described later) of the reversal portion 80 and the elastic deformation portion 90 can be made independent. As a result, for example, the degree of freedom in design for obtaining the following effects can be enhanced. For example, vibration or sound when the reversal portion 80 that will be described later is reversed can be clearly generated. In addition, for example, a repulsive force up to the threshold value can be increased in proportion to the displacement amount, and in particular, the proportional relationship can be maintained even in the vicinity of the threshold value (the degree of increase in the repulsive force is not relaxed). As a result, the pressure assumed by the user is directly reflected in the repulsive force in the region up to the displacement amount reaching the upper limit pressure, so that the brushing load can be appropriately controlled. In a case where the degree of increase in the repulsive force is gradually relaxed in the vicinity of the threshold value, the user may unintentionally continue brushing at a pressure near the upper limit. In addition, when the gaps S are communicated with both sides of the reversal portion 80 in the thickness direction, the effect is further improved. By widening the gaps S in the thickness direction, the vector of the load applied to a brush portion (bristle) during brushing, the direction where the gaps open, and the direction where the reversal portion 80 and the elastic deformation portion 90 are deformed are made parallel to each other (refer to FIG. 7), and it is easy to link the generation of vibration or sound due to reversing with the brushing load. Furthermore, when the gaps S are passed through the front surface side and the back surface side by the through-hole K, for example, the movable region of the elastic deformation portion 90 which is responsible for the bending function of the toothbrush skeleton with respect to the load during brushing can be further expanded (the tensile behavior on the front surface and the compression behavior on the back surface due to bending are unlikely to be hindered). In a case where there is no through-hole K between the elastic deformation portion 90 and the reversal portion 80, the movable region of the elastic deformation portion 90 is narrow. In this case, the reversal portion 80 is not assigned an opportunity to reverse in an appropriate load range, and it is assumed that the reversal portion 80 is reversed before reaching the appropriate load range, or is not reversed even within the appropriate load range. On the other hand, by providing the through-hole K between the elastic deformation portion 90 and the reversal portion 80, the "threshold value" at which the reversal portion 80 that will be described later reverses can be controlled in a fine range. The gaps S may not penetrate in the thickness direction, and may be formed inside the elastic deformation portion 90 by a closed cavity extending in the long axis direction. In addition, the gaps S may include hollows (to be described later) that open on the front surface side or the back surface side.

Each elastic deformation portion 90 includes a hard portion 90H and a soft portion 90E. As illustrated in FIG. 1, the hard portion 90H and the soft portion 90E connect a rear end of the neck portion 20 and a front end of the grip portion 30. As illustrated in FIGS. 3 and 4, a hollow (recessed portion) 71 that opens on the front surface side and a hollow (recessed portion) 72 that opens on the back surface side are provided between the pair of elastic deformation portions 90. The bottom portions of the hollow 71 and the hollow 72 on both end sides in the width direction are connected to the through-holes K. The reversal portion 80 is exposed and provided at the bottom portions of the hollow 71 and the hollow 72 at the center in the width direction. By providing the hollows 71 and 72, for example, the movable region of the elastic deformation portion that bears the bending function of the toothbrush skeleton with respect to the load during brushing can be further expanded, and the bending anisotropy in the thickness direction can be improved. The hollows between the pair of elastic deformation portions 90 may not penetrate in the thickness direction, or may open in only one of the thickness directions. In addition, for example, a closed cavity extending in the long axis direction may be formed inside the elastic deformation portion 90, and the cavity may be interposed in the center to form a pair of elastic deformation portions in the width direction.

In the pair of elastic deformation portions 90, the end portions of the soft portions 90E in the long axis direction are connected to each other in the width direction on both the front surface side and the back surface side. The soft portions 90E of the pair of elastic deformation portions 90 are provided at the periphery of the oval hollows 71 and 72 in the front view. The rear end side of the soft portion 90E is connected to the soft portion 31E of the grip portion 30.

Since the soft portion 90E is connected in the width direction on both the tip end side and the rear end side of the elastic deformation portion 90, stress is unlikely to be concentrated on the end of the hinge structure even when the reversing is repeated, and it is unlikely to break. In addition, since the soft portion 90E is connected in the width direction, the amount of heat possessed by the soft resin (elastomer) during injection molding increases, which enhances the adhesiveness between the neck portion 20 and the sound generation portion 70 (neck portion 20 and elastic deformation portion 90). Furthermore, the anisotropy in the sound generation portion 70 is increased by connecting the soft portions 90E in the width direction on both the tip end side and the rear end side of the elastic deformation portion 90. For example, the pair of elastic deformation portions 90 can be bent without twisting in the thickness direction with respect to the movement during brushing.

Figure 5:
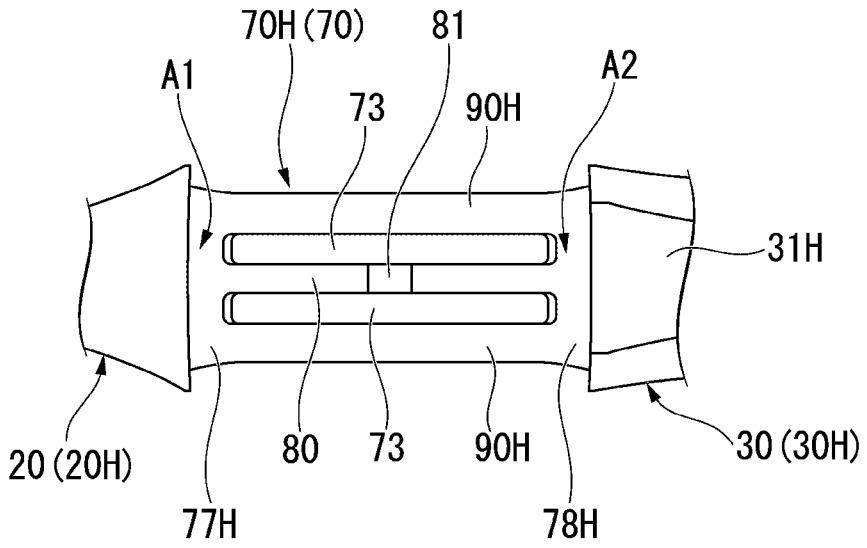
FIG. 5 is a partial front view in a vicinity of the sound generation portion 70 in a hard portion 70H.
Figure 6:
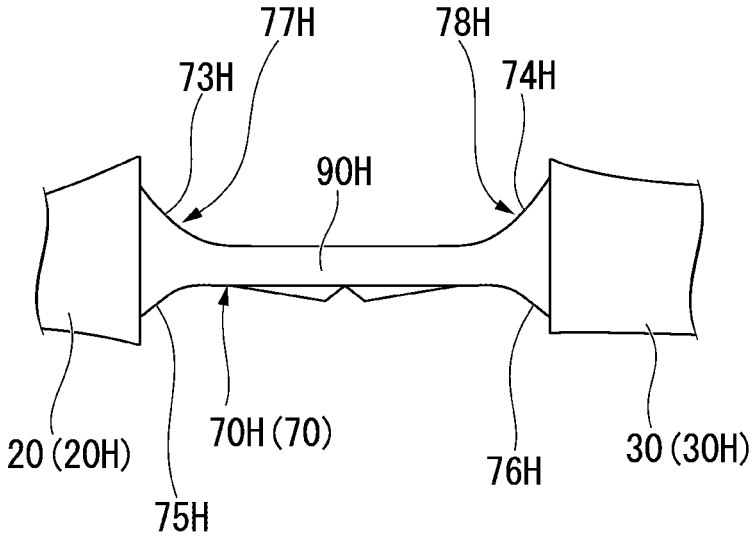
FIG. 6 is a partial side view in the vicinity of the sound generation portion 70 in the hard portion 70H.
Figure 7:
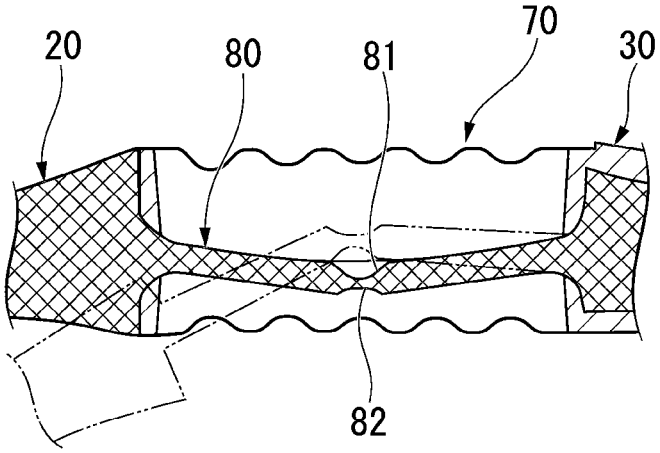
FIG. 7 is a cross-sectional view of the sound generation portion 70 along a plane parallel to the thickness direction and the long axis direction for describing reversal of a reversal portion.

FIG. 5 is a partial front view in a vicinity of a hard portion 70H in the sound generation portion 70. FIG. 6 is a partial side view in the vicinity of the hard portion 70H in the sound generation portion 70.

As illustrated in FIG. 5, the hard portion 70H is formed in a rectangular shape in a plan view connecting the hard portion 20H which is the head portion 20 and the hard portion 30H of the grip portion 30 in the long axis direction.

The hard portion 70H includes a support portion 77H that supports the end portion on the tip end side of the pair of hard portions 90H and the end portion on the tip end side of the reversal portion 80 and connects these portions in the width direction, and a support portion 78H that supports the end portion on the rear end side of the pair of hard portions 90H and the end portion on the rear end side of the reversal portion 80 and connects these portions in the width direction.

As illustrated in FIG. 6, the tip end side of the hard portion 70H (support portion 77H) on the front surface side is connected to the hard portion 20H by a curved surface 73H having an arc shape in the side view. The rear end side of the hard portion 70H (support portion 78H) on the front surface side is connected to the hard portion 30H by a curved surface 74H having an arc shape in the side view. The arc centers of the curved surfaces 73H and 74H are located on the front surface side from the hard portion 70H in the side view. The tip end side of the hard portion 70H on the back surface side is connected to the hard portion 20H by a curved surface 75H having an arc shape in the side view. The rear end side of the hard portion 70H on the back surface side is connected to the hard portion 30H by a curved surface 76H having an arc shape in the side view. The arc centers of the curved surfaces 75H and 76H are located on the back surface side from the hard portion 70H in the side view.

In a case where the curved surfaces 73H to 76H do not exist, stress may be concentrated on the boundary between the tip end side of the hard portion 70H and the hard portion 20H and the boundary between the rear end side of the hard portion 70H and the hard portion 30H. On the other hand, since the curved surfaces 73H to 76H exist, the concentrated stress can be relaxed. Furthermore, since the curved surfaces 73H to 76H exist, both the elastic deformation portion 90 and the tip end side and the rear end side of the reversal portion 80 can be flexibly deformed (the degree of deformation of the elastic deformation portion 90 that triggers reversing can be sensed more finely).

The hard portion 70H includes through-holes 73 provided on both sides of the reversal portion 80 in the width direction. The through-holes 73 extend in the long axis direction. The length of the through-hole 73 in the long axis direction is a length at which a tip end side end portion of the through-hole 73 is separated from the hard portion 20H and a rear end side end portion of the through-hole 73 is separated from the hard portion 30H. As illustrated in FIG. 3, of the through-holes 73, the soft portion 90E is provided near the hard portion 90H in the width direction, and the through-hole K is formed near the reversal portion 80 in the width direction.

In the hard portion 70H, since the hard portion 90H is disposed on both sides in the width direction with the reversal portion 80 as the center through the through-hole 73, even when a load is applied and the elastic deformation portion 90 is deformed, the shape of the reversal portion 80 can be maintained. When the hard portion H constituting the toothbrush 1 over the entire length is bent, the reversal portion 80 of the sound generation portion 70 is reversed in an attempt to release the accumulated strain energy. For example, in a case where the hard portion 70H is connected to the neck portion 20 and the grip portion 30 only by the reversal portion 80, since the energy cannot be accumulated, the hard portion 70H is immediately reversed. When the reversal portion 80 is integrally injection-molded with a first region A1 and a second region A2 that will be described later, the neck portion 20, the grip portion 30, and the hard portion 70H, the accumulated strain energy can be efficiently transferred to the reversal portion.

The hard portion 90H is formed on the outside of the hard portion 70H in the width direction from the through-hole 73. As illustrated in FIG. 3, the hard portion 90H has a substantially rectangular cross-sectional shape. The hard portion 90H is embedded in the soft portion 90E. Since the hard portion 90H is embedded in the soft portion 90E, the stress applied to the hard portion 90H can be relaxed from the viewpoint of strength. In addition, from the viewpoint of the degree of bending of the toothbrush 1 with respect to the load, it is possible to control the elastic behavior of the elastic deformation portion 90. In addition, the bending anisotropy of a sensing portion 70 is increased, and for example, the elastic deformation portion 90 can be bent without twisting in the thickness direction with respect to the movement during brushing.

Examples of the material of the hard portion H include a resin having a flexural modulus (JIS7171) of 1500 MPa or more and 3500 MPa or less, and for example, include a polyacetal resin (POM). The flexural modulus of the hard portion H is more preferably 2000 MPa or more and 3500 MPa or less. By using a material having a high elastic modulus (for example, POM), even when the shape is made narrow or thin, when an excessive load is applied, the snap buckling occurs and the vibration and the sound are expressed. In addition, by using a material having a high elastic modulus, it is possible to rapidly return to an initial state (state where the bending of the elastic deformation portion 90 is released) after the snap buckling occurs.

As an example, the material of the soft portion E preferably has a shore hardness A of 90 or less, and more preferably a shore hardness A of 50 to 80, so that the load when the snap buckling occurs is close to a recommended brushing load value. Examples of the soft resin include elastomers (for example, olefin-based elastomers, styrene-based elastomers, polyester-based elastomers, and polyurethane-based thermoplastic elastomers) and silicones. A styrene-based elastomer is preferable because styrene-based elastomers have excellent miscibility with polyacetal resins.

As illustrated in FIG. 5, the reversal portion 80 extends in the long axis direction in the front view, and connects the first region A1 on the tip end side of the through-hole 73 and the second region A2 on the rear end side of the through-hole 73 in the hard portion 70H. The reversal portion 80 is formed in substantially a V shape in a side view which gradually inclines toward the back surface side from both end portions in the long axis direction toward the center, in a first stable state (hereinafter referred to as a first state) illustrated in FIG. 4 in which no external force is applied to the back surface side of the head portion 10 (or an external force equal to or less than a predetermined threshold value that will be described later is applied). That is, in the first state, the reversal portion 80 is formed in a protrusion shape on the back surface side where the center in the long axis direction is the apex.

For example, when an external force to the back surface side is applied to the head portion 10 while the grip portion 30 is gripped, in a case where the magnitude of the external force is equal to or less than a predetermined threshold value, the elastic deformation portion 90 and the reversal portion 80 are elastically deformed according to the magnitude of the external force. When an external force is applied, bending energy is accumulated in the reversal portion 80 as the elastic deformation portion 90 bends.

In a case where the magnitude of the external force exceeds a predetermined threshold value, the elastic deformation portion 90 elastically deforms according to the magnitude of the external force exceeding the threshold value. On the other hand, in a case where the magnitude of the external force exceeds a predetermined threshold value, as illustrated by a two dot chain line in FIG. 7, the reversal portion 80 snaps, buckles, and reverses to be in a second stable state (hereinafter referred to as a second state) when the neck portion 20 is deformed. In the second state, the reversal portion 80 is reversed in a direction that is substantially a reversed V shape in the side view which gradually inclines toward the front surface side toward the center. In the second state, the reversal portion 80 is formed in a protrusion shape on the front surface side where the center in the long axis direction is the apex.

That is, in a case where the magnitude of the external force exceeds a predetermined threshold value, since the elastic deformation portion 90 elastically deforms with the displacement of the head portion 10, the reversal portion 80 snaps, buckles, and reverses from the first state to the second state, in a state where the bending strength of the sound generation portion 70 is ensured. In addition, since the through-hole K is provided between the reversal portion 80 and the elastic deformation portion 90, the reversal portion 80 and the elastic deformation portion 90 can be deformed independently of each other, and the reversal portion 80 can be easily reversed. That is, since the through-hole K is provided when a brushing load is applied, the reversal portion 80 can be bent after only the elastic deformation portion 90 is first bent without either hindering the deformation behavior of the other. The space between the reversal portion 80 and the elastic deformation portion 90 does not necessarily penetrate, and a gap S may be formed.

When the reversal portion 80 snaps, buckles, and reverses, a click sound is generated by the vibration in which the accumulated bending energy is released at once. Therefore, the user who grips the grip portion 30 can sense that it is in an over-brushing state where the external force applied to the head portion 10 on the back surface side exceeds the threshold value.

Since the reversal portion 80 is provided to be exposed to the space of the hollow 71 that opens on the front surface side and the hollow 72 that opens on the back surface side, the click sound generated when the reversal portion 80 is reversed can reach the user in a state where there is little loss. Therefore, the user can be likely to hear the click sound during brushing. In order to cause the user to be likely to hear the click sound, the position of the reversal portion 80 is preferably close to the head portion 10 close to the user s ear.

Since the loudness of a human audible sound depends on both the sound pressure level and the frequency, it is necessary to consider both the sound pressure level and the frequency in order to make the sound sufficiently audible during brushing.

Since the sound is likely to be heard during brushing, the click sound generated from the sound generation portion 70 preferably has a characteristic sound pressure level of 30 dB or more, and more preferably 40 dB or more. As the sound pressure level increases, the frequency that humans can hear is wider, and even low frequencies (for example, 100 Hz) and high frequencies (for example, 10000 Hz) can be heard by humans.

In order to cause the sound to be likely to be heard during brushing, the frequency of the click sound generated from the sound generation portion 70 is preferably 100 Hz or more and 10000 Hz or less, and more preferably 500 Hz or more and 6500 Hz or less. In a case where the frequency of the click sound generated from the sound generation portion 70 is less than 100 Hz, or the frequency exceeds 10000 Hz, the click sound may be difficult to hear.

The reversal portion 80 includes a groove portion 81 at the center in the long axis direction on the front surface side, that is, in a region including an apex of the protrusion shape. The reversal portion 80 includes a groove portion 82 at the center in the long axis direction on the back surface side, that is, in a region including the apex of the protrusion shape. The groove portions 81 and 82 extend in the width direction. The groove portion 81 is formed in an arc shape in the side view in which the center of the arc is disposed on the front surface side. The groove portion 82 is formed in an arc shape in the side view in which the center of the arc is disposed on the back surface side. In a case where the reversal portion 80 is not provided with the groove portions 81 and 82, stress is uniformly generated in the entire reversal portion 80, and snap buckling is unlikely to occur. On the other hand, when the groove portions 81 and 82 are provided in the reversal portion 80, stress is intensively generated in the groove portions 81 and 82, and snap buckling is likely to occur.

The radius of the arc-shaped groove portions 81 and 82 in the side view is preferably 1 mm or more and 2 mm or less. In a case where the radius of the groove portions 81 and 82 is less than 1 mm, the reversal portion 80 may not be reversed. In a case where the radius of the groove portions 81 and 82 exceeds 2 mm, since the vibration of the reversal portion 80 at the time of reversing is decreased and a sufficient click sound is not expressed, the over-brushing state may be difficult to perceive.

As for the depth of the groove portions 81 and 82, it is preferable that the groove portion 81 is deeper than the groove portion 82. In a case where the groove portion 82 is deeper than the groove portion 81, the reversal portion 80 is unlikely to be reversed even in a case where the magnitude of the external force exceeds a predetermined threshold value. In addition, in a case where the groove portion 81 is deeper than the groove portion 82, the reversal portion 80 can be guided to be more likely to snap and buckle on the front surface side.

Configurations in which neither of the groove portions 81 and 82 is provided and in which the groove portion 82 is not provided and only the groove portion 81 is provided are also possible.

Since the reversal portion 80 is provided with the groove portions 81 and 82 in the region including the apex of the protrusion shape, the region including the apex of the protrusion shape is thinner than the other regions. Therefore, the strain energy accumulated by the deformation of the reversal portion 80 due to the external force exceeding the threshold value can be instantly released starting from the groove portions 81 and 82, and the reversal portion 80 can be reversed to generate the click sound. In addition, the positions of the groove portions 81 and 82 in the thickness direction can be adjusted to adjust the position where the reversal portion 80 reverses from the first state to the second state.

In addition, since the groove portions 81 and 82 are formed in an arc shape in the side view, for example, as compared with the case where the groove portions 81 and 82 are formed in a V shape on two intersecting planes, even when the apex of the reversal portion 80 including the groove portions 81 and 82 moves in the thickness direction, the stress concentration at the apex can be relaxed.

As illustrated in FIG. 4, the distance dl in the thickness direction between an intersection portion on the back surface side of the support portions 77H and 78H in the reversal portion 80 and the apex of the protrusion shape is preferably 0.5 mm or more and 4.2 mm or less. The intersection portion on the back surface side of the support portions 77H and 78H in the reversal portion 80 is a position where the surface of the reversal portion 80 on the back surface side and the curved surfaces 75H and 76H of the support portions 77H and 78H intersect (in the side view, a position where the straight line on the back surface side of the reversal portion 80 and the curves of the curved surfaces 75H and 76H intersect). In a case where the distance dl in the thickness direction is less than 0.5 mm, the energy that can be accumulated is small, and the reversal portion 80 may be reversed even with an appropriate load equal to or less than the threshold value. In addition, since the energy released at the time of reversing is small, the click sound may not be sufficiently expressed. In a case where the distance dl in the thickness direction exceeds 4.2 mm, it may be difficult for the reversal portion 80 to snap, buckle, and reverse due to the over-brushing pressure, or when the reversal portion 80 snaps, buckles, and reverses, the reversal portion 80 may break and lose reversibility.

When the distance dl in the thickness direction is within the above range, the bending energy generated in the toothbrush 1 converges on the reversal portion 80, and the accumulated energy is released at once when the reversal portion 80 is reversed (during over-brushing). As a result, the click sound is expressed and it is possible to make the user aware of the over-brushing.

The threshold value of the external force applied to the head portion 10 on the back surface side is, for example, an upper limit value of an appropriate brushing pressure.

As illustrated in FIG. 4, the angle θ at which the reversal portion 80 is inclined to the plane parallel to the long axis direction and the width direction is preferably 5 degrees or more and 11 degrees or less. In a case where the inclination angle θ is less than 5 degrees, the reversal portion 80 does not snap and buckle and does not express a click sound, and thus the over-brushing state may be difficult to perceive. In a case where the inclination angle θ exceeds 11 degrees, it may be difficult for the reversal portion 80 to snap, buckle, and reverse due to the over-brushing pressure and to express a click sound, or the reversal portion 80 may be broken and the reversibility may be lost when the reversing is performed by snapping and buckling.

The thickness of the reversal portion 80 is preferably 1 mm or more and 2 mm or less, and more preferably 1.2 mm or more and 1.8 mm or less, excluding the groove portions 81 and 82. In a case where the thickness of the reversal portion 80 is less than 1 mm, when an external force that causes over-brushing is applied, since it is difficult for energy of the deformed portion to accumulate, a click sound is not easily generated and the over-brushing state is present may be difficult to perceive. When the thickness of the reversal portion 80 exceeds 2 mm, deformation due to the external force does not easily occur and the bending energy cannot be released. Therefore, it may be difficult for the reversal portion 80 to snap, buckle, and reverse due to the over-brushing pressure and to express a click sound, or the reversal portion 80 may be broken and the reversibility may be lost when the reversing is performed by snapping and buckling.

The minimum thickness of the reversal portion 80 in the region where the groove portions 81 and 82 are formed is preferably 0.1 mm or more and 1.0 mm or less, and more preferably 0.3 mm or more and 0.8 mm or less. In a case where the minimum thickness of the reversal portion 80 is less than 0.1 mm, when an external force that causes over-brushing is applied, the reversal portion 80 is gently deformed and it is difficult for energy to accumulate, and therefore a click sound may not be easily generated. When the minimum thickness of the reversal portion 80 exceeds 1.0 mm, it is difficult for deformation due to an external force to occur and the bending energy cannot be released, and therefore a click sound is not easily generated.

Assuming that the maximum thickness of the reversal portion 80 is T (mm) and the maximum thickness of the sound generation portion 70 (elastic deformation portion 90) is t (mm), by defining a value represented by T/t, it is possible to control the ease of reversing of the reversal portion 80 and the timing (threshold value) thereof when an excessive brushing load is applied. The value represented by T/t is preferably 0.05 or more and 0.35 or less, and more preferably 0.10 or more and 0.35 or less. In a case where the value represented by T/t is less than 0.05, although the reversal portion 80 also deforms in a form that follows the bending of the sound generation portion 70 (elastic deformation portion 90), the reversal portion 80 does not snap and buckle and does not express a click sound, and therefore the over-brushing state may be difficult to perceive. When the value represented by T/t exceeds 0.35, it may be difficult for the reversal portion 80 to snap, buckle, and reverse due to the over-brushing pressure and to express a click sound, or the reversal portion 80 may be broken and the reversibility of the reversal portion 80 may be lost when the reversing is performed by snapping and buckling.

That is, by setting T/t within the above ranges, the bending strength of the reversal portion 80 is flexible at a constant ratio for the elastic deformation portion 90, and the reversal portion 80 can be operated with a slight delay for the bending of the elastic deformation portion 90 that bears the handle skeleton. As a result, even when an excessive brushing load is applied, it is possible to control the ease of reversing of the reversal portion 80 and the timing (threshold value) that triggers the reversal portion 80 to reverse.

The maximum thickness t of the elastic deformation portion 90 is preferably 6 mm or more and 12 mm or less, and more preferably 8 mm or more and 10 mm or less. In a case where the maximum thickness t of the elastic deformation portion 90 is less than 6 mm, the rigidity of the elastic deformation portion 90 is small, and even if the reversal portion 80 is deformed, the reversal portion 80 may not snap and buckle and a click sound may not be expressed. In addition, in a case where the maximum thickness t of the elastic deformation portion 90 is less than 6 mm, the energy that can be accumulated is small, and the reversal portion 80 may be reversed even with an appropriate load equal to or less than the threshold value. When the maximum thickness t of the elastic deformation portion 90 exceeds 12 mm, the rigidity of the elastic deformation portion 90 is too large, and it may be difficult for bending energy to accumulate in the reversal portion 80.

As illustrated in FIG. 3, assuming that the maximum width of the reversal portion 80 is L (mm) and the maximum width of the sound generation portion 70 is W (mm), by defining a value represented by L/W, for example, it is possible to control the ease of reversing of the reversal portion 80 and the timing (threshold value) thereof when an excessive brushing load is applied. The value represented by L/W is preferably 0.05 or more and 0.35 or less, and more preferably 0.10 or more and 0.35 or less. In a case where the value represented by L/W is less than 0.05, although the reversal portion 80 also deforms in a form that follows the bending of the sound generation portion 70 (elastic deformation portion 90), the reversal portion 80 does not snap and buckle and does not express a click sound, and therefore the over-brushing state may be difficult to perceive. When the value represented by L/W exceeds 0.35, the reversal portion 80 is unlikely to be deformed and reversed due to the bending of the handle body 2 that occurs in the range of normal brushing. Therefore, it may be difficult for the reversal portion 80 to snap, buckle, and reverse due to the over-brushing pressure and to express a click sound, or the reversal portion 80 may be broken and the reversibility of the reversal portion 80 may be lost when the reversing is performed by snapping and buckling. By setting the value represented by L/W within the above range, it is possible to operate the reversal portion 80 with a slight delay against the bending of the elastic deformation portion 90 that bears the handle skeleton. Therefore, even when an excessive brushing load is applied, it is possible to control the ease of reversing of the reversal portion 80 and the timing (threshold value) that triggers the reversal portion 80 to reverse.

The maximum width L of the reversal portion 80 is preferably 15 mm or less. When the maximum width L of the reversal portion 80 exceeds 15 mm, it is difficult for deformation due to an external force to occur and bending energy cannot be released, and therefore a click sound is not easily generated.

The length of the reversal portion 80 in the long axis direction is preferably 15 mm or more and 30 mm or less, more preferably 15 mm or more and 25 mm or less, and even more preferably 15 mm or more and 20 mm or less. The position of the tip end side end portion of the reversal portion 80 is the position of the tip end side end portion of the through-hole 73. The position of the rear end side end portion of the reversal portion 80 is the position of the rear end side end portion of the through-hole 73. In a case where the length of the reversal portion 80 in the long axis direction is less than 15 mm, it may be difficult for the reversal portion 80 to snap, buckle, and reverse due to the normal brushing pressure and to express a click sound, and the deformation required for snapping, buckling and expressing a click sound may not be generated. In a case where the length of the reversal portion 80 in the long axis direction exceeds 30 mm, the displacement required for snapping and buckling is significantly increased, which significantly reduces usability, the deformation behavior of the reversal portion 80 is the same as that of the elastic deformation portion 90, and the reversal portion 80 does not snap and buckle.

The reversal portion 80 is located between the outer contour of the bristle tufting surface side 11 and the outer contour of the back surface side of the elastic deformation portion 90 in the side view. More specifically, the position of the reversal portion 80 in the thickness direction is set so as not to protrude from the thickness of the elastic deformation portion 90 in the side view so that the reversal portion 80 does not form the outermost contour of the toothbrush. Therefore, for example, it is possible to prevent the reversal portion from coming into contact with the user during use. Specifically, it is preferable that the elastic deformation portion 90 be on the back surface side of the position where the thickness is halved. In a case where the position of the reversal portion 80 in the thickness direction is on the back surface side of the position where the thickness of the sound generation portion 70 is halved, when the reversal portion 80 is reversed to be in the second state, the possibility of the apex of the reversal portion 80 protruding from the front surface on the front surface side of the elastic deformation portion 90 and coming into contact with the user s finger can be reduced. In addition, since the reversal portion 80 is disposed on the back surface side of the position where the thickness of the elastic deformation portion 90 is halved, when the reversal portion 80 is bent, the back surface side is compressed rather than the front surface side, and therefore energy that triggers the reversing easily accumulates, and the strain energy can be efficiently transferred to the reversal portion 80.

The flexural modulus of the hard resin constituting the reversal portion 80 is preferably 1500 MPa or more and 3500 MPa or less, and more preferably 2000 MPa or more and 3500 MPa or less. In a case where the flexural modulus of the hard resin is less than 1500 MPa, even if the reversal portion 80 deforms, the reversal portion 80 does not snap and buckle and does not express a click sound, and therefore the over-brushing state may be difficult to perceive. In a case where the flexural modulus of the hard resin exceeds 3500 MPa, it may be difficult for the reversal portion 80 to snap, buckle, and reverse due to the over-brushing pressure and to express a click sound, or the reversal portion 80 may be broken and the reversibility of the reversal portion 80 may be lost when the reversing is performed by snapping and buckling. In addition, by using a material having a defined flexural modulus, vibrations associated with snap buckling are intensively generated in a short time and are sensitive (sharp, large), and a sufficient click sound is generated. As a result, the user can easily become aware of the over-brushing.

When the reversal portion 80 snaps and buckles, the moving distance of the apex of the protrusion shape in the thickness direction is preferably 0.2 mm or more and 5.0 mm or less. In a case where the moving distance of the apex in the thickness direction is less than 0.2 mm, the vibration at the time of snapping and buckling is decreased, and the click sound may not be sufficiently expressed. In a case where the moving distance of the apex in the thickness direction exceeds 5.0 mm, it may be difficult for the reversal portion 80 to snap, buckle, and reverse due to the over-brushing pressure and to express a click sound, or the reversal portion 80 may be broken and the reversibility of the reversal portion 80 may be lost when the reversing is performed by snapping and buckling. When the moving distance of the reversal portion 80 is within the above range when the snap buckling occurs, the vibration generated by the snap buckling is intensively generated in a short time and is sensitive (sharp, large). As a result, the click sound is expressed and the user can easily become aware of the over-brushing.

In addition, the range in the thickness direction where the reversal portion 80 is reversed is preferably 1% or more and 30% or less, and more preferably 3% or more and 15% or less of the maximum thickness t of the elastic deformation portion 90, centering on a line segment connecting the center points of the support portions 77H and 78H in the thickness direction. In a case where the reversing range of the reversal portion 80 is less than 1% of the maximum thickness t, the vibration at the time of snapping and buckling is decreased, and the click sound may not be sufficiently expressed and may be difficult to hear. In a case where the reversing range of the reversal portion 80 exceeds 30% of the maximum thickness t, it may be difficult for the reversal portion 80 to snap, buckle, and reverse due to the over-brushing pressure and to express a click sound, or the reversal portion 80 may be broken and the reversibility of the reversal portion 80 may be lost when the reversing is performed by snapping and buckling.

The thickness of the hard portion 90H in the elastic deformation portion 90 is preferably 1.0 mm or more and 2.0 mm or less, and the width is preferably larger than the thickness. In a case where the thickness of the hard portion 90H is less than 1.0 mm, the energy that can be accumulated is small, and the reversal portion 80 may be reversed even with an appropriate load equal to or less than the threshold value. In addition, since the energy released at the time of reversing is small, the click sound may not be sufficiently expressed. In a case where the thickness of the hard portion 90H is 2.0 mm or less, the hard portion 90H is in a plane stress state, and therefore the hard portion 90H is unlikely to generate internal stress. As a result, the elastic deformation portion 90 is unlikely to break even when deformed, and by sufficiently accumulating the energy required for the reversing the reversal portion 80, it is possible to effectively express the click sound.

In addition, in the toothbrush 1 of the present embodiment, since the reversal portion 80 and the elastic deformation portion 90 are disposed in the width direction, the sound generation portion 70 can be more easily deformed on the front surface side and the back surface side, and can be in a plane stress state where the sound generation portion 70 is substantially not deformed in the long axis direction and the width direction. That is, in the toothbrush 1 of the present embodiment, the directions where the reversal portion 80 and the elastic deformation portion 90 are deformed are the thickness directions separated from each other in the width direction, and are not present on the same plane. In other words, a path where the elastic deformation portion 90 is deformed due to the external force in the thickness direction and a path where the reversal portion 80 is deformed due to the external force in the thickness direction are provided in a non-interfering manner. Therefore, in the toothbrush 1 of the present embodiment, since the elastic deformation portion 90 and the reversal portion 80 are unlikely to be constrained by each other and can be deformed, it is possible to more sufficiently accumulate the energy required for the reversing of the reversal portion 80, stress is intensively generated in the reversal portion 80 (particularly the groove portions 81 and 82), and it is possible to express a click sound by performing a sharp snap buckling.

In addition, since the toothbrush 1 of the embodiment is suppressed from being shaken in the width direction, the bending in the thickness direction due to brushing can be transmitted to the reversal portion 80 without loss. In addition, by disposing the reversal portion 80 and the elastic deformation portion 90 in the width direction, the bending of the elastic deformation portion 90 and the reversing of the reversal portion 80 can be made independent and the timing can be shifted. In a case where the elastic deformation portion 90 and the reversal portion 80 are disposed in the thickness direction, the roles of the bending of the elastic deformation portion 90 and the reversing of the reversal portion 80 may be hindered from each other.

As described above, in the toothbrush 1 of the present embodiment, the elastic deformation portion 90 that elastically deforms at least until an external force at which the reversal portion 80 snaps, buckles, and reverses, and the reversal portion 80 that snaps, buckles, and reverses due to an external force to the back surface side which exceeds the threshold value are disposed with a gap in the width direction. Therefore, when an external force exceeding a predetermined threshold value is applied to the head portion 10 to the back surface side, since the click sound can be expressed by the vibration when the reversal portion 80 snaps, buckles, and reverses, the user who grips the grip portion 30 can sense the over-brushing state where the external force applied to the head portion 10 on the back surface side exceeds the threshold value.

EXAMPLES

Hereinafter, the present invention will be described in detail with reference to examples, but the present invention is not limited to the following examples and can be appropriately modified and performed without departing from the gist thereof.

Examples 1 to 9, Comparative Example 1

According to the specifications illustrated in [Table 1], toothbrushes differing in the presence or absence of a sound generation portion, the characteristic sound pressure level, the click frequency, the number of elastic deformation portions, the number of reversal portions, the interference relationship between the elastic deformation portion and the reversal portion, the positional relationship (alignment direction) between the elastic deformation portion and the reversal portion, and the flexural modulus of the elastic deformation portion and the hard portion of the reversal portion were used as samples of Examples 1 to 9 and Comparative Example 1. The thickness of the elastic deformation portion in each sample was 9.8 mm. The thickness of the hard portion of the elastic deformation portion in each sample was 2.0 mm.

In Examples 1 to 3, a toothbrush having the sound generation portion described in the above embodiment was used as a sample. In Example 4, a toothbrush in which the elastic deformation portions were disposed via the gaps on both sides in the thickness direction with the reversal portion interposed therebetween was used as a sample. In Example 5, a toothbrush in which the reversal portion and one elastic deformation portion were disposed via the gaps on one side and the other side in the thickness direction was used as a sample. In Example 6, a toothbrush having a so-called butterfly hinge type reversal portion, which was not provided with an elastic deformation portion, extends in the long axis direction, and had a bowl-shaped arc shape in which the cross-sectional shape along a plane including the width direction and the thickness direction was a protrusion shape on the back surface side, was used as a sample. In Example 7, a toothbrush in which the elastic deformation portion had the same configuration as that of Example 1, the first engaging portion whose base end was located on the rear end side of the sound generation portion and extended toward the tip end side, and the second engaging portion whose base end was located on the tip end side of the sound generation portion and extended toward the rear end side were disposed with the gaps in the thickness direction and separated from the elastic deformation portion, instead of the reversal portion, and the positional relationship in the thickness direction was reversed after they were engaged with each other when the external force in the thickness direction exceeded the threshold value, was used as a sample. In Example 8, a toothbrush provided with no gap between the elastic deformation portion and the reversal portion was used as a sample with respect to the sample of Example 1. In Example 9, a toothbrush in which the hard portion of the elastic deformation portion was not covered with the soft portion was used as a sample with respect to the sample of Example 1. In Comparative Example 1, a toothbrush (Clinica Advantage Toothbrush manufactured by Lion Corporation) having no sound generation portion (reversal portion and elastic deformation portion) was used as a sample. The bristle tufting portion had the same specifications as that of the Clinica Advantage Toothbrush.

Measurement Method of Click Sound

For each sample, the grip portion 30 side was fixed from the boundary between the sound generation portion 70 and the grip portion 30 so that the bristle tufting surface of the head portion was horizontal. A click sound was measured when a load was applied vertically downward to the center of the head portion 10 at a constant speed (100 mm/min) to reverse the reversal portion. The measurement was performed using a microphone placed at a distance of 15 cm (15 cm in the front surface side direction from the deformation portion) from the sample, assuming the distance from the center of the sound generation portion to the user s ear (the average value of three measurements was adopted). The measurement was performed in a quiet room where the measurement sound was not affected.

Evaluation Method of Click Sound (Survey Method)

A questionnaire was performed after a total of 10 pieces, one for each of the toothbrush samples from Examples 1 to 9 and the toothbrush sample from Comparative Example 1, were used for 1 week. The subjects of the survey were eight toothbrush specialist panelists who could appropriately control the brushing load.

Regarding ease of hearing the click sound, significantly easy to hear" was set as 4 points, "easy to hear" was set as 3 points, audible was set as 2 points, and inaudible was set as 1 point. The average score obtained for each sample was used (an index of ease of understanding force adjustment). The average value of the scores was rounded off between the second decimal place and the first decimal place.

Regarding ease of expressing the click sound under the over-brushing load, when the over-brushing load is applied, the sound is significantly accurately linked and expressed was set as 4 points, when the over-brushing load is applied, the sound is accurately linked and expressed was set as 3 points, when the over-brushing load is applied, the sound is linked and expressed was set as 2 points, and when the over-brushing load is applied, the sound is not linked was set as 1 point. The average score obtained for each sample was used (an index of ease of understanding force adjustment). The average value of the scores was rounded off between the second decimal place and the first decimal place. In this survey, the threshold value for the over-brushing load was set to 200 g.

Regarding the evaluation results, those with an average score of 2.0 points or more were regarded as passing (OK), and those with an average score of less than 2.0 points were regarded as failure (NG).

TABLE 1

| | Example 1 | Example 2 | Example 3 | Example 4 | Example 5 | Example 6 | Example 7 | Example 8 | Example 9 | Comparative Example 1 |
|---|---|---|---|---|---|---|---|---|---|---|
| Presence or absence of sound generation portion | Presence | Presence | Presence | Presence | Presence | Presence | Presence | Presence | Presence | Absence |
| Number of elastic deformation portions | 2 | 2 | 2 | 2 | 1 | 0 | 2 | 2 | 2 | 0 |
| Number of reversal portions | 1 | 1 | 1 | 1 | 1 | 1 | 0 | 1 | 1 | 0 |
| Interference between elastic deformation portion and reversal portion | Non-interference | Non-interference | Non-interference | Interference | Interference | Non-interference | Non-interference | Interference | Non-interference | — |
| Positional relationship between elastic deformation portion and reversal portion | Width direction | Width direction | Width direction | Thickness direction | Thickness direction | Width direction | Width direction | Width direction | Width direction | — |
| Flexural modulus of elastic deformation portion and hard resin of reversal portion (MPa) | 2500 | 3500 | 1500 | 2500 | 2500 | 1000 | 2500 | 2500 | 2500 | 2550 |
| Sound pressure level (dB) | 71 | 80 | 32 | 31 | 68 | 50 | 58 | 30 | 72 | — |
| Frequency (Hz) | 5472 | 5061 | 644 | 312 | 5655 | 1017 | 4079 | 287 | 6655 | — |
| Ease of hearing sound (points) | 3.8 | 3.9 | 2.1 | 2.0 | 3.6 | 2.5 | 3.1 | 2.0 | 3.5 | 1.0 |
| Ease of expressing sound under over-brushing load (points) | 3.8 | 2.9 | 3.9 | 2.3 | 2.3 | 2.5 | 3.0 | 2.0 | 2.4 | 1.0 |

As illustrated in [Table 1], in the samples of Examples 1 to 9 having the sound generation portion, the A characteristic sound pressure level was 30 dB or more, the frequency was 100 Hz or more and 10000 Hz or less, and the samples passed (OK) in both "ease of hearing the click sound", and "ease of expressing the click sound under the over-brushing load. On the other hand, the sample of Comparative Example 1 having no sound generation portion did not express a click sound and failed (NG).

In addition, for the samples of Examples 1 to 5 and 7 to 9 in which the flexural modulus of the elastic deformation portion and the hard resin of the reversal portion was 1500 MPa or more, it was confirmed that the samples passed (OK) in both ease of hearing the click sound and ease of expressing the click sound under the over-brushing load.

Although the preferred embodiments according to the present invention are described above with reference to the accompanying drawings, it goes without saying that the present invention is not limited to the above examples. The various shapes and combinations of the constituent members described in the above-described examples are examples, and can be variously changed based on design requirements and the like without departing from the gist of the present invention.

For example, in the above embodiment, the configuration in which the sound generation portion 70 is provided between the neck portion 20 and the grip portion 30 is illustrated, but the invention is not limited to this configuration. The sound generation portion 70 may have a configuration provided in the neck portion 20 or a configuration provided in the grip portion 30.

In addition, although the configuration in which one reversal portion 80 is provided in the sound generation portion 70 is illustrated in the above embodiment, the invention is not limited to this configuration, and a configuration in which a plurality of reversal portions 80 are provided may be provided.

For example, in a case where two reversal portions 80 are provided, one is formed to have a thickness and inclination angle θ that are reversed at the upper limit value of the appropriate brushing load, and the other is formed to have a thickness and inclination angle θ that are reversed at the lower limit value of the appropriate brushing load. Therefore, it is possible to easily define both the upper limit value and the lower limit value of the brushing load.

In addition, although the configuration in which the reversal portion 80 is reversed in the thickness direction is illustrated in the above embodiment, the invention is not limited to this configuration. For example, the reversal portion 80 may be configured to be reversed in the width direction, or in a diagonal direction orthogonal to the long axis direction and intersecting the width direction and the thickness direction. By adopting a configuration in which the reversal portion 80 is reversed in the diagonal direction, it is possible for over-brushing to be perceived during brushing by a rolling method.

INDUSTRIAL APPLICABILITY

The present invention can be applied to a toothbrush.

REFERENCE SIGNS LIST

1: Toothbrush
2: Handle body
10: Head portion
11: Bristle tufting surface
20: Neck portion
30: Grip portion
70: Sound generation portion
77H, 78H: Support portion
80: Reversal portion
81, 82: Groove portion
E. 31E. 32E: Soft portion
H: Hard portion
S: Gap

What is claimed is:

1. A toothbrush comprising:

a head portion provided on a tip end side in a long axis direction and having a bristle tufting surface;

a grip portion disposed on a rear end side from the head portion;

a neck portion disposed between the bristle-tufting surface and the grip portion; and a sound-generation portion that generates a click sound due to deformation when an external force in a first direction orthogonal to the bristle-tufting surface exceeds a threshold value, the sound-generation portion being provided on a rear end side from the bristle tufting surface;

wherein, when the external force exceeds the threshold value, the sound generation portion includes a reversal portion that generates the click sound by being snapped, buckled, and reversed as the head portion is displaced on a back-surface side opposite the bristle-tufting surface in the first direction;

wherein the sound-generation portion further includes an elastic-deformation portion that connects a first region on the tip-end side of the sound-generation portion and a second region on the rear-end side of the sound-generation portion, and elastically deforms at least up to the external force at which the sound generation portion generates the click sound;

wherein a thickness of the elastic-deformation portion in the first direction is in the range of 6-mm to 12-mm;

the sound-generation portion further includes support portions made of the hard resin on both end sides in the long-axis direction, and supporting both ends of the elastic-deformation portion and the reversal portion in the long-axis direction, and the reversal portion is reversed in a range of 1% to 30% of the thickness of the elastic-deformation portion in the first direction, centering on a line segment connecting center points of thicknesses of the support portions in the first direction.

2. The toothbrush according to claim 1, wherein a sound generated from the sound generation portion has a characteristic sound pressure level of 30 dB or more, and a frequency of 100 Hz or more and 10000 Hz or less.

3. The toothbrush according to claim 1, wherein the elastic deformation portion and the reversal portion are disposed with a gap in a second direction orthogonal to the first direction and the long axis direction.

4. The toothbrush according to claim 1, wherein the elastic deformation portion includes a hard portion made of a hard resin and a soft portion made of a soft resin and covering the hard portion, and the reversal portion is made of a hard resin having a flexural modulus of 1500 MPa or more.

5. The toothbrush according to claim 4, wherein a thickness of the hard portion in the first direction is 1.0 mm or more and 2.0 mm or less.

6. The toothbrush according to claim 1, wherein the reversal portion has a protrusion shape toward the back surface side when an external force in the first direction is equal to or less than a threshold value, and a distance between an intersection portion on the back surface side with the support portion and an apex of the protrusion shape in the first direction is 0.5 mm or more and 4.2 mm or less.

7. The toothbrush according to claim 6, wherein the reversal portion includes a groove portion extending in the second direction on at least one of the bristle tufting surface side and the back surface side in a region including the apex of the protrusion shape.

8. The toothbrush according to claim 7, wherein a minimum thickness of the reversal portion in a region provided with the groove portion in the first direction is 0.1 mm or more and 1.0 mm or less.

* * * * *